US010441875B2

(12) United States Patent
King, II

(10) Patent No.: US 10,441,875 B2
(45) Date of Patent: Oct. 15, 2019

(54) LOW LIGHT GAME SYSTEM AND METHOD

(71) Applicant: Judd Paul King, II, Los Angeles, CA (US)

(72) Inventor: Judd Paul King, II, Los Angeles, CA (US)

( * ) Notice: Subject to any disclaimer, the term of this patent is extended or adjusted under 35 U.S.C. 154(b) by 0 days.

(21) Appl. No.: 15/883,923

(22) Filed: Jan. 30, 2018

(65) Prior Publication Data

US 2019/0046869 A1 Feb. 14, 2019

Related U.S. Application Data

(63) Continuation of application No. 14/927,172, filed on Oct. 29, 2015, now abandoned.

(51) Int. Cl.

| | |
|---|---|
| ***A63F 9/30*** | (2006.01) |
| ***A63F 9/24*** | (2006.01) |
| ***F21V 33/00*** | (2006.01) |
| ***F21V 23/04*** | (2006.01) |
| ***F21S 10/02*** | (2006.01) |
| ***F21Y 115/10*** | (2016.01) |

(52) U.S. Cl.

CPC ..... *A63F 9/30* (2013.01); *A63F 9/24* (2013.01); *F21S 10/023* (2013.01); *F21V 23/0407* (2013.01); *F21V 23/0435* (2013.01); *F21V 33/008* (2013.01); *A63F 2009/2454* (2013.01); *A63F 2009/2486* (2013.01); *F21Y 2115/10* (2016.08)

(58) Field of Classification Search

CPC ..... A63B 67/00; A63B 71/06; A63C 19/06; A61B 5/00

See application file for complete search history.

(56) References Cited

U.S. PATENT DOCUMENTS

| | | | | |
|---|---|---|---|---|
| 6,004,232 | A | 12/1999 | Sennott | |
| 9,795,177 | B1 * | 10/2017 | Weaver | A42B 3/046 |
| 2005/0162257 | A1 | 7/2005 | Gonzalez | |
| 2007/0097505 | A1 | 5/2007 | Desjardin | |
| 2009/0005196 | A1 * | 1/2009 | Kessler | A63B 63/00 473/476 |
| 2009/0233739 | A1 * | 9/2009 | Minarovic | A63C 19/08 473/490 |
| 2011/0183783 | A1 | 7/2011 | Rahim et al. | |

(Continued)

OTHER PUBLICATIONS

Wikihow; "3 Ways to Play Capture the Flag"; [Retrieved on Aug. 7, 2015]; 7 pages; Retrieved online from [<URL: http://www.wikihow.com/Play-Capture-the-Flag >].

*Primary Examiner* — Eugene L Kim
*Assistant Examiner* — Christopher Glenn
(74) *Attorney, Agent, or Firm* — Thorpe North & Western

(57) ABSTRACT

A kit of parts for playing a capture the flag game in low-light conditions is disclosed herein. The kit can include a number of flags, each of the flags carrying one or more light emitting diodes (LEDs) operable to provide a visual signal; a number of territory markers, each of the territory markers carrying one or more LEDs operable to provide a visual signal; and a number of jail markers, each of the jail markers carrying one or more LEDs operable to provide a visual signal. The flags, the territory markers, and the jail markers are configured to be selectively disposable upon or attachable to the terrain.

20 Claims, 3 Drawing Sheets

(56) References Cited

U.S. PATENT DOCUMENTS

| | | | | |
|---|---|---|---|---|
| 2013/0107507 | A1 | 5/2013 | Tucker et al. | |
| 2013/0178312 | A1* | 7/2013 | Marks | A63B 71/06 473/415 |
| 2016/0058335 | A1 | 3/2016 | Ashby | |

* cited by examiner

LOW LIGHT GAME SYSTEM AND METHOD

RELATED APPLICATIONS

This application is a continuation of U.S. patent application Ser. No. 14/927,172 filed Oct. 29, 2015, with which is hereby incorporated by reference in its entirety.

BACKGROUND

Many multi-player athletic games can be played and enjoyed in well-lit conditions in various urban, suburban, and rural environments. However, unique issues can arise when these games are attempted in low-light conditions. There can be difficulties and inherent limitations associated with gameplay in reduced visibility conditions. Some of these issues can add to the competitive challenge of the game. Other aspects of low-light conditions may limit the typical options and strategies used during gameplay in normal lighting conditions.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
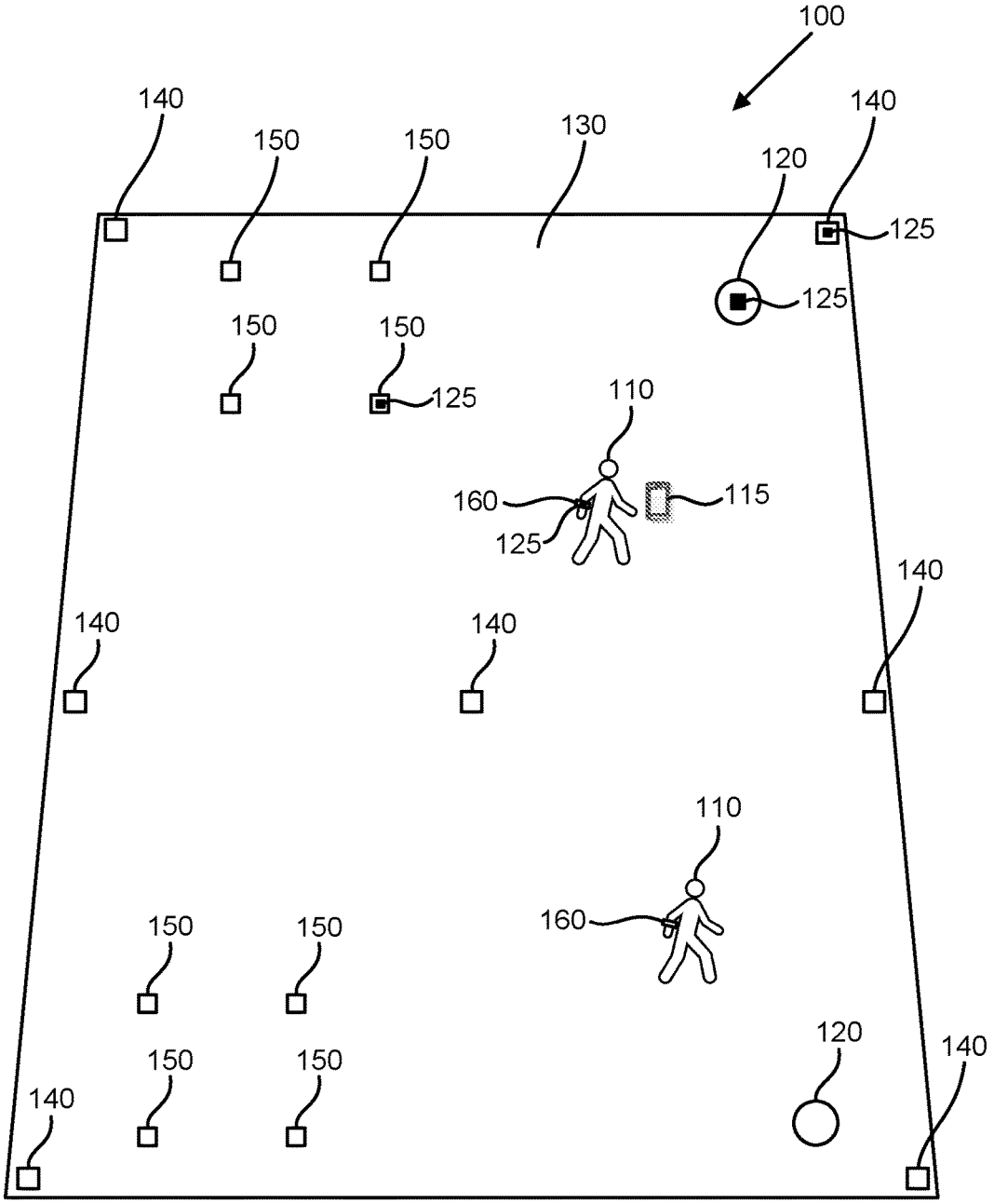
FIG. 1 is a schematic depiction of an example of a kit of parts for playing a capture the flag game in low-light conditions according to the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

Although the following detailed description contains many specifics for the purpose of illustration, a person of ordinary skill in the art will appreciate that many variations and alterations to the following details can be made and are considered to be included herein.

Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

"The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under" and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

As used herein, "enhanced," "improved," "performance-enhanced," "upgraded," and the like, when used in connection with the description of a device or process, refers to a characteristic of the device or process that provides measurably better form or function as compared to previously known devices or processes. This applies both to the form and function of individual components in a device or process, as well as to such devices or processes as a whole.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the relative placement of one object with respect to another object. In some examples, objects that are described as being "adjacent" to one another may be in a side-by-side or other similar positional relationship that can include objects that are in direct contact with one another and objects that are in close proximity to one another. The exact degree of proximity may in some cases depend on the specific context.

As used herein, "coupled" refers to a relationship of connection or attachment between one item and another item, and includes relationships of either direct or indirect connection or attachment. Any number of items can be coupled, such as materials, components, structures, layers, devices, objects, etc.

As used herein, "directly coupled" refers to a relationship of physical connection or attachment between one item and another item, where the items have at least one point of direct physical contact.

As used herein, "indirectly coupled" refers to a relationship of connection or attachment between one item and another item where the items do not have a point of direct physical contact with one another. Rather, such items can be connected, attached, or joined together by an intermediate item. For example, when a first layer of material is bound or joined to a second layer of material using an intermediate layer in between the first and second layer, the first and second layers can be said to be indirectly coupled.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

FIG. 1 depicts a schematic of an example of a game field 100 using an example of a kit of parts for playing a capture the flag game in low-light conditions. The capture the flag game can be played with at least two teams and at least one player 110 on each team. Examples of the kit of parts can include a number of flags 120 configured to be selectively disposable upon or attachable to a terrain 130.

It is to be understood that the terrain 130 can be any suitable playing environment, including indoor and outdoor areas. The level of light for low-level light gameplay can include the absence of any ambient light sources for apparent total darkness. In some examples of low-level light gameplay, there may be sufficient light to see the ground and any obstacles within the field of play. Further, environments of uniform or non-uniform surfaces can be used for gameplay. For example, an indoor or outdoor athletic field can be used such as a field otherwise used for football, soccer, or the like. Also, areas such as basketball or tennis courts may be used as a playing environment. The athletic field may be partially or totally exposed to external conditions of weather and lighting. An enclosed gymnasium can be used with lighting controls to vary a level of lighting within the gymnasium as desired for the level of visibility desired for gameplay. Alternatively, other environments including natural landscapes of trees, hills and other features may be used for gameplay. Other indoor environments including various obstacles may be used as well. In an example, the flags 120 may be placed upon the terrain 130 including by placing the flag on a chair in an open gymnasium or in a tree in an outdoor playing environment. The flags 120 may be placed in any suitable position, including on the ground surface, for example on grass, dirt or pavement.

Each of the flags 120 can carry one or more light emitting diodes (LEDs) operable to provide a visual signal. It is to be understood that LEDs as used herein can be any light source, including organic LEDs (OLEDs), bioluminescent lights, and other low-power consuming light sources. The LEDs can be selectively actuated by a player 110 and can indicate a status of that player 110. For example, the LED can indicate a color identifiable with a particular team. Each flag 120 may contain a single color of LED to be associated with a single team. Alternatively, each flag 120 can include two or more different colors of LEDs, or LEDs that are configurable to operate in different colors to enable each flag 120 to be used to represent two or more teams.

Examples of the kit of parts can also contain a number of territory markers 140 and a number of jail markers 150. Each of the territory markers 140 and each of the jail markers 150 can carry one or more LEDs operable to provide a visual signal. Each territory marker 140 or jail marker 150 may contain a single color of LED to be associated with a single team. Alternatively, each territory marker 140 or jail marker 150 can include two or more different colors of LEDs, or LEDs that are configurable to operate in different colors to enable each territory marker 140 or jail marker 150 to be used to represent two or more teams.

The territory markers 140 and the jail markers 150 can be configured to be selectively disposable upon or attachable to the terrain 130 in order to define upon the terrain 130 a game play territory area for each of the at least two teams. Similar to the flags 120, the territory markers may be placed on the terrain in any suitable manner. The territory markers 140 and the jail markers 150 can be used to delineate boundaries of certain zones related to the capture the flag game. For example, a jail may be a square or other shape outlined on the terrain or game field by the jail markers 150 located wholly within the territory of one of the teams. The game play territory may be marked by the territory markers 140 included with the kit. In some examples, the LED can provide boundary or target information about the territory of a team or about the entire game field depending on the applicable rules of play.

Examples of the kit of parts can also include a number of team identifiers 160 carryable by the players 110. Each of the team identifiers 160 can have one or more LEDs operable to provide a visual signal. Additionally, each of the team identifiers 160 can be operable to identify a team affiliation for the at least one player 110 on each team of the capture the flag game by a color identifiable for the affiliated team. Each team identifier 160 may contain a single color of LED to be associated with a single team. Alternatively, each team identifier 160 can include two or more different colors of LEDs, or LEDs that are configurable to operate in different colors to enable each team identifier 160 to be used to represent two or more teams. The team identifiers 160 can be bands worn by the player 110 in any location that is visible for identification of the band by another player 110. For example, the team identifier 160 can be worn on the head, wrist, arm, leg, neck, chest or torso of a player 110. The team identifier 160 can also be carried upon a player 110 by attachment to clothing or personal equipment of the player 110 at a desired location. For example, a team identifier may be a blue LED light located on the chest and/or back of a player 110. In other examples, the team identifiers 160 may be wristbands configured to be releaseably operatively attached to the wrist of the players 110. Any suitable attachment mechanism can be used. For example, the bands can be fixed length or variable length and can have a variety of clasping mechanisms to help the band stay on the player 110.

Figure 2A:
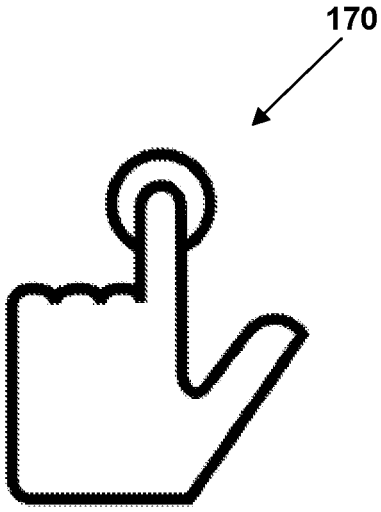
FIG. 2A is a schematic depiction of an example of a button according to the present disclosure.
Figure 2B:
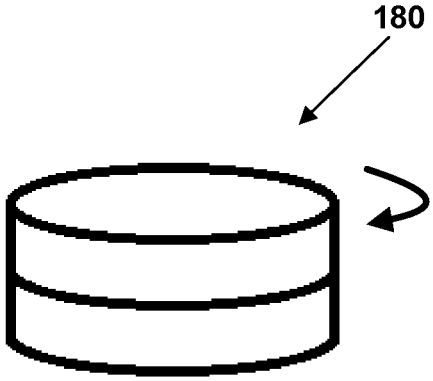
FIG. 2B is a schematic depiction of an example of a twist mechanism according to the present disclosure.

Each of the flags 120, territory markers 140, jail markers 150, and team identifiers 160 can have a button 170 or a twist mechanism 180 that is configured to activate the one or more LEDs carried on each of the items as shown, for example, in FIGS. 2A and 2B. The button 170 or twist mechanism 180 can also be used to activate selected groups of LEDs, such as a certain color of LED. The button 170 or twit mechanism 180 can also be used to select a desired color for one or more of LEDs carried on each item.

The examples of the button 170 or twist mechanism 180 are not intended to be limiting. Other types of mechanical or electrical activation and deactivation schemes can also be used. For example, the one or more LEDs on the flags 120, territory markers 140, jail markers 150, and team identifiers 160 may be connected with a wireless sensor 125, such as a Bluetooth sensor or an Institute of Electronics and Electrical Engineers (IEEE) 802.11 (Wi-Fi) sensor. For example, the Wi-Fi sensor can be configured to communicate with a controller via a WiFi standard, such as IEEE 802.11-2012, 802.11ac, 802.11ad, 802.11af, 802.11ah, 802.11ai, 802.11aq, 802-11ax, or another desired wireless standard. The wireless sensors 125 can be used to activate, deactivate, or change one or more colors of LEDs carried on each of the items via a controller, such as a stand-alone controller. The wireless sensor controller 125 can also be used to provide status information. In one embodiment, the wireless sensor controller can be configured to communicate with a wireless device 115. The wireless device 115 can also be configured to operate as a controller. The wireless device can include a smart phone, a watch, a tablet, or another desired mobile computing device.

In another embodiment, the one or more LEDs on the flags 120, territory markers 140, jail markers 150, and team identifiers 160 can be connected with a wireless sensor controller 125 configured to communicate in a personal area network, such as a Bluetooth network. As previously discussed, the wireless sensor controller 125 in one or more flags 120, territory markers 140, jail markers 150, and team identifiers 160 can communicate with a wireless device 115, such as a smart phone, tablet, watch, or other type of mobile computing device associated with a player, referee, or non-participant. The smart phone, watch, tablet, or mobile computing devices of the player or referee can then be configured to communicate with the wireless devices of other players, referees, or non-participants using a different radio access technology, such as WiFi, as previously discussed, or a cellular technology standard, such as the third generation partnership project (3GPP) standard over a significantly larger distance. The wireless devices may communicate via an access point or base station, or directly with other wireless devices. Example standards include 3GPP long term evolution (LTE) Release 8, 9, 10, 11 or 12. The wireless devices can communicate with the wireless sensor controllers 125 while in proximity of the wireless sensor controllers 125. For example, the wireless sensor controllers 125 may transmit up to 30 meters using Bluetooth. The wireless devices 115 can then communicate the information to other wireless devices using a WiFi or cellular standard connection over a longer distance, such as hundreds or thousands of meters. Using the wireless devices, information can be communicated between players, referees, and non-participants regarding a status of the flags, territory markers, jail markers, and players.

In some examples, one or more of the flags 120 can further include color changing LEDs. The color changing LEDs can be configured to provide at least one of rotating multiple colors in a gradient color changing, flashing multiple colors one after the other, and flashing the same color on and off repeatedly in a pattern.

In some examples, the one or more LEDs carried on the number of flags 120, the number of territory markers 140, the number of jail markers 150, or the team identifiers 160 can be configured to identify a special status of the at least one player 110. In some examples, a player 110 or other person may be designated as a referee or other special purpose player, with certain rules and exceptions applied due to the special status agreed upon. The special status can be identified based on a selected color or flashing pattern of the one or more LEDs. For example, a flashing team identifier 160 on a player may indicate a special status for that player such as with a variation of game play. In one example, a single player 110 from each team may be identified as an "angel". In this example, the angel is the only player 110 eligible to free teammates from an opposing team's jail. The angel can be identified as such by the color or flashing pattern of the team identifier 160 carried on that player 110. Other selected rule variations may be applied to the gameplay as agreed by the teams or referee, if any. Another variation may allow the referee to have a discretionary power for rule violations, poor sportsmanship, and mismatched teams. This discretionary power can allow the referee to send any player to jail at any time during gameplay.

An example of a system is disclosed for establishing a game field 100 for playing a capture the flag game in low-light conditions with at least two teams and at least one player 110 on each team. The system can include a number of flags 120, a number of territory markers 140, a number of jail markers 150, and a number of team identifiers 160 as described in examples herein.

An example of typical game play using the kit of parts for playing a capture the flag game in low-light conditions can proceed with two or more teams of one or more players each. The objective of the game is for players 110 to make their way into the opposing team's territory, grab the flag 120 and return with it to their own territory without being tagged. The flag 120 is defended mainly by tagging opposing players 110 who attempt to take it. Within their own territory players 110 are "safe", meaning that they cannot be tagged by opposing players 110. Once they cross in to the opposing team's territory they are vulnerable to being tagged. Each team has a territory defined by territory markers 140. Each player 110 has a team identifier 160 operatively connected thereto. Each team has a jail area defined by placement of jail markers 150. Each team places a flag 120 on their own territory. Game play starts when each team is ready and a signal is made for the game to begin, such as a game leader or referee announcing, "Go!" After game play starts, players 110 from each team may advance into an opposing team's territory to try to capture the opposing team's flag 120 and return with the flag 120 to their own territory. If the flag 120 is successfully retrieved and delivered to the team's territory without that player 110 being tagged by a player 110 from the opposing team, victory is declared and the game is concluded. If, during gameplay, a player 110 is tagged while on opposing team territory by an opposing team player 110, the tagged player 110 is jailed by relocation to the jail area of the opposing team. Jailed players 110 may be "freed" by their teammates if their teammates are able to tag them free without themselves being tagged first.

Figure 3:
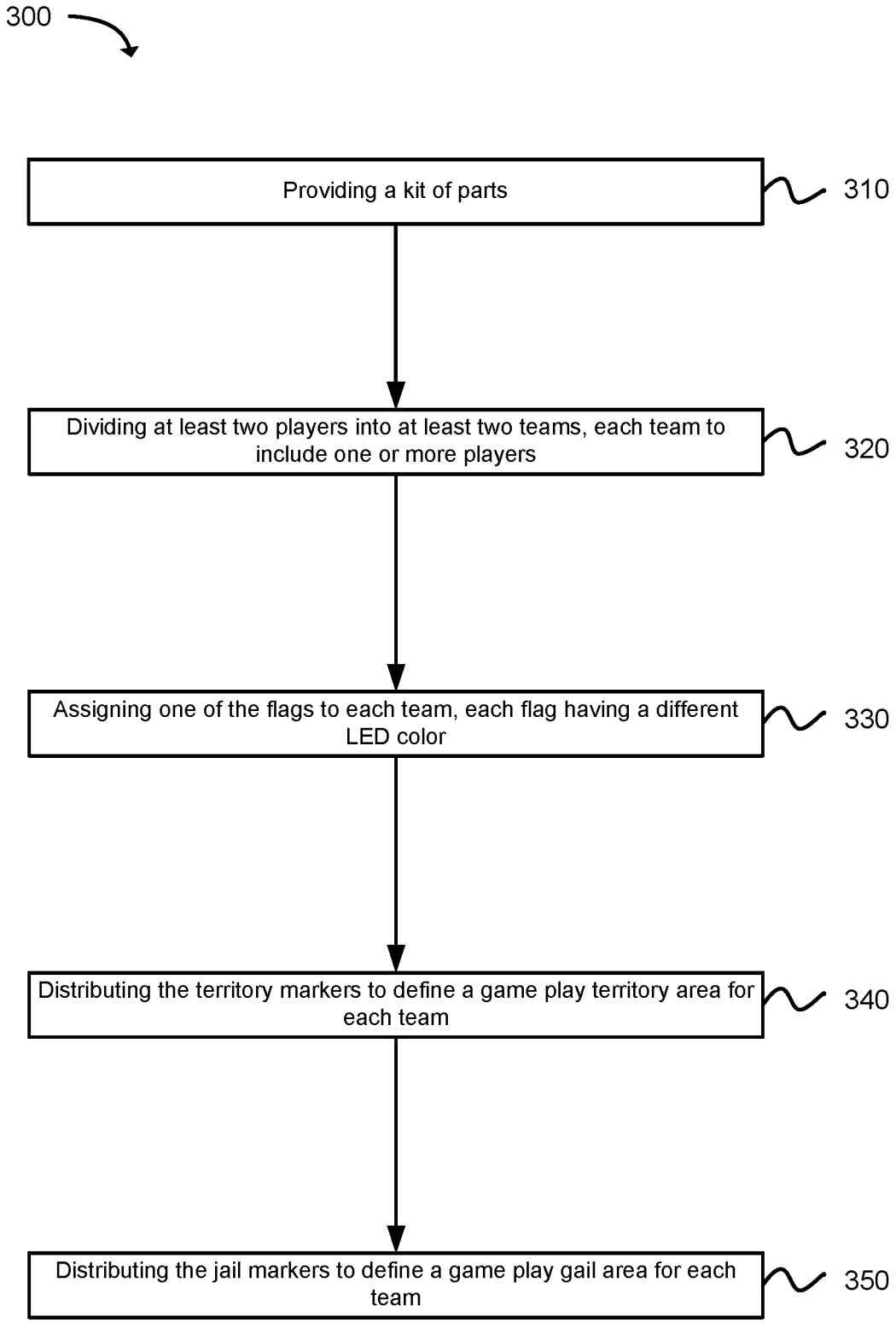
FIG. 3 is a flow diagram of an example of a method of establishing game play for a capture the flag game in low-light conditions according to the present disclosure.

FIG. 3 depicts an example of a method of establishing game play for a capture the flag game in low-light conditions with at least two players 110. The method 300 includes, as shown at 310, providing a kit of parts as described in examples herein and, as shown at 320, dividing the at least two players 110 into at least two teams. Each team can include one or more players 110. The method 300 further includes, as shown at 330, assigning one of the flags 120 to each team. Each flag 120 can have a different LED color. The method 300 still further includes, as shown at 340, distributing the territory markers 140 to define a game play territory area for each team and, as shown at 350, distributing the jail markers 150 to define a game play jail area for each team. Examples of the method 300 can also include activating the flag LEDs by modulating a button on the flag 120. Examples of the method 300 can also include activating the flag 120 LEDs by twisting a twist mechanism on the flag 120.

The method 300 can further include configuring one or more of the flags 120 as color changing LEDs, wherein the color changing LEDs are to provide at least one of rotating multiple colors in a gradient color changing, flashing multiple colors one after the other, and flashing the same color on and off repeatedly in a pattern.

The method 300 can also include identifying a special status of the at least one player 110 or a referee. The special status can be identifiable based on a selected color or flashing pattern of the one or more LEDs carried on the number of flags 120, the number of territory markers 140, the number of jail markers 150, or the number of team identifiers 160.

The method 300 can also include identifying a special status of the at least one referee. This referee can be designated as "The Wizard." This player may have a special indication to be identifiable based on a selected color LED or flashing pattern of the one or more team identifiers 160. The Wizard can have the power to shout "freeze" and cause all players 110 to stop moving. He or she may then reposition players 110 or the flags 120 for up to sixty seconds, then shout "unfreeze" (resume movement).

The method 300 can include a variety of game play variations. One variation can include identifying one player 110 on each team to carry the flag 120 for the player's team during game play. In this way, the player 110 holding the flag 120 effectively becomes the flag 120 with the addition of movement by the player 110. Also, the player 110 holding the flag 120 cannot hide the flag 120 or pass the flag 120 to another player 110. Once one team's flag carrying player 110 is tagged, the opposing team wins.

Another game play variation can comprise having no jails 150 for either team but instead offering a special status to one player 110 on both teams. In one example, the special status player can be referred to as "The Angel", or another desired designation. This player may have special identification to be identifiable based on a selected color LED or flashing pattern of the one or more team identifiers 160. In this variation, the tagging of a player 110 can cause the tagged player 110 to freeze in place (stop moving entirely). The tagged player may resume movement when an Angel tags him or her. Angels who are tagged can be removed from the game until its conclusion.

Another game play variation can comprise having no jails 150 for either team but instead offer special status to one player 110 on both teams. In one example, the special status player can be referred to as "The Ghoul". The special status player may have special status to be identifiable based on a selected color LED or flashing pattern of the one or more team identifiers 160. In this variation, if a Ghoul is on his or her home territory and tags an opposing player, the player can be required to leave the game entirely.

Another game play variation can allow players 110 who are in jail to link arms or hands to extend beyond the periphery of the jails markers 150 so long as one jailed player remains within the jail periphery.

The ability to remotely detect and/or control the one or more LEDs on the flags 120, territory markers 140, jail markers 150, and team identifiers 160 using the wireless sensor controllers 125 and one or more wireless device(s) 115 can allow additional variations of capture the flag. In one embodiment, a game application (i.e. app) can be designed to operate on the wireless device and configured to allow a user (i.e. a game player or a non-player) to control and/or detect the one or more LEDs using the wireless device operating the app. Depending on the communication scheme, the app can be used to sync the wireless device 115 with the wireless sensor controllers 125 in the flags 120, territory markers 140, jail markers 150, and team identifiers 160. The wireless device 115 and app can then be used to control and detect the one or more LEDs on the flags 120, territory markers 140, jail markers 150, and team identifiers 160 to enable new forms of game play.

For example, in a territory swap game play variation, the LED colors used to designate team identifiers 160 and/or territory markers 140 can be changed remotely at a selected point in a game. In one example, a non-player can use a wireless device 115 to set off a "remote detonator" that alters the colors of the LEDs and causes team members to have to quickly move to not be caught in the other team's territory. Alternatively, the wireless device 115 may be configured to communicate a signal at a random time period during game play to the wireless sensor controllers 125 to alter the colors of the team identifiers 160 or territory markers 140. In another embodiment, the wireless sensor controller 125 can be manually set to change color of one or more LEDs in the flags 120, territory markers 140, jail markers 150, and team identifiers 160 at a selected or random time period during game play.

Another game play variation can include including having no jails 150 for either team but providing each player 110 with multiple team identifiers 160. In this variation, the tagging of a player 110 causes the tagged player 110 to give up a team identifier 160 and return to their own territory. A player 110 is out of the game when that player 110 loses all of their team identifiers 160.

Still another game play variation can include two teams using an alternate playing field arrangement including a single perimeter of territory markers 140 around a single flag 120. In this example, one of the two teams includes only one player 110. This player 110 is designated as a "renegade" and starts the game in a self-selected position within the playing field. The rest of the players are on the opposing team, with the object being to capture the renegade by tagging. The opposing team is restricted from entry into the playing field until the renegade is in position.

Still another game play variation can include two teams using an alternate playing field arrangement including only the periphery of the field being marked by territory markers 140. One of the two teams can begin by including only a single player 110. In one example, the single player 110 can be designated as a "Werewolf." The other players can face away from the playing field while the Werewolf hides one flag 120 and starts the game in a self-selected position within the playing field. The rest of the players can be on the opposing team, with the object being to capture the flag without being tagged by the Werewolf. All tagged players can become additional Werewolves and can be required to either remove their team identifier 160 or change an LED color of the team identifier.

Yet still another game play variation can include a "traitor" on each team. The traitor is a player 110 designated by blind selection of the opposing team such that the traitor's teammates are unaware of the identity of the traitor. The traitor plays the game as normal until a team affiliation is switched during game play. At the time of the traitor's reveal, the team identifier 160 can be used to notify the former teammates of the traitor of the team affiliation switch by changing the special status indicated by the team identifier 160.

While many examples have been discussed with respect to playing a capture the flag game, it is to be understood that various types of games with a variety of rule variations can be utilized with examples and equivalents of those disclosed herein.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method of establishing game play for a capture the flag game in low-light conditions with at least two players, comprising:

providing a kit of parts, the kit of parts including:

a number of flags configured to be selectively disposable upon or attachable to a terrain, each of the flags carrying one or more light emitting diodes (LEDs) operable to provide a visual signal;

a number of territory markers, each of the territory markers carrying one or more LEDs to provide a visual signal, the territory markers configured to be selectively disposable upon or attachable to the terrain in order to define upon the terrain a game play territory area for each of at least two teams; and a number of jail markers, each of the jail markers carrying one or more LEDs to provide a visual signal, the jail markers configured to be selectively disposable upon or attachable to the terrain in order to define upon the terrain a game play jail area for each of the at least two teams;

dividing the at least two players into the at least two teams, each team to include one or more players;

assigning one of the flags to each team, each flag having a different LED color;

distributing the territory markers to define a game play territory area for each team;

distributing the jail markers to define a game play jail area for each team within each team's territory area; and placing the flags within a corresponding team's territory area.

2. The method of claim 1, wherein the kit of parts further comprises a number of team identifiers carryable by the at least two players, each of the team identifiers carrying one or more LEDs to provide a visual signal; and further comprising distributing the team identifiers to the at least two players, each team identifier of one team having a different LED color than each team identifier of the other team.

3. The method of claim 2, further comprising the number of team identifiers comprising bands wearable on the of the players.

4. The method of claim 1, wherein the number of territory markers comprises at least seven territory markers; and wherein distributing the territory markers further comprises distributing the territory markers to define a polygon with at least three of the markers arrayed intersecting the polygon at a midpoint to define the territory areas for each team.

5. The method of claim 1, wherein the number of territory markers comprises at least six territory markers; and wherein distributing the territory markers further comprises distributing the territory markers to define two polygons defining two territories.

6. The method of claim 1, wherein the number of jail markers comprises at least four jail markers; and wherein distributing the jail markers further comprises distributing the jail markers to define a polygon.

7. The method of claim 1, further comprising:

players from each of the at least two teams advancing into an opposing team's territory area and attempting to capture the opposing team's flag and return with the opposing team's flag to the players' own territory;

players from each of the at least two teams attempting to tag opposing players while on the opposing team's territory area, defining a tagged player;

the tagged player relocating to the jail area of the opposing team; and players of the tagged players team attempting to tag the tagged player in the jail area, thereby freeing the tagged player from the jail area.

8. A method of establishing game play on a terrain in low-light conditions with at least first and second teams and multiple players on each team, comprising:

assigning a first flag having a light emitting diode (LED) providing a first color assigned to the first team;

assigning a second flag having an LED providing a second color, different from the first color, to the second team;

distributing a plurality of territory markers each having an LED providing a third color, different from the first and second colors, to define a game play territory area upon the terrain for each of the first and second teams; and placing each flag in a respective territory area of a corresponding team with the objective of capturing an opposing team's flag.

9. The method of claim 8, wherein distributing the plurality of territory markers further comprises distributing at least seven territory markers defining a polygon with at least three of the markers arrayed intersecting the polygon at a midpoint to define the territory areas for each team.

10. The method of claim 8, wherein distributing the territory markers further comprises distributing at least six territory markers defining first and second territories for the first and second teams, respectively.

11. The method of claim 8, further comprising:

distributing a first plurality of jail markers each having an LED providing the first color to define a first game play jail area within the terrain for the first team; and distributing a second plurality of jail markers each having an LED providing the second color to define a second game play jail area within the terrain for the second team.

12. The method of claim 11, wherein distributing the first and second plurality of jail markers further comprises distributing the jail markers to define a polygon within each of the first and second team's territory area, respectively.

13. The method of claim 8, further comprising:

distributing a first plurality of team identifiers carryable by players of the first team, each of the first plurality of team identifiers having an LED providing the first color to identify team affiliation for the players on the first team; and distributing a second plurality of team identifiers carryable by players of the second team, each of the second plurality of team identifiers having an LED providing the second color to identify team affiliation for the players on the second team.

14. The method of claim 13, wherein the first and second plurality of team identifiers comprising bands wearable on the wrists of the players.

15. The method of claim 8, further comprising:

distributing a first plurality of team identifiers carryable by players of the first team, each of the first plurality of team identifiers having an LED providing the first color to identify team affiliation for the players on the first team;

distributing a second plurality of team identifiers carryable by players of the second team, each of the second plurality of team identifiers having an LED providing the second color to identify team affiliation for the players on the second team;

distributing a first plurality of jail markers each having an LED providing the first color to define a first game play jail area upon the terrain for the first team; and distributing a second plurality of jail markers each having an LED providing the second color to define a second game play jail area upon the terrain for the second team; and the first color being associated with the first flag, the first plurality of team identifiers and the first plurality of jail markers;

the second color being associated with the second flag, the second plurality of team identifiers and the second plurality of jail makers; and the third color being associated with the plurality of territory markers.

16. The method of claim 8, further comprising:

players from each of the at least two teams advancing into an opposing team's territory area and attempting to capture the opposing team's flag and return with the opposing team's flag to the players' own territory; and players from each of the at least two teams attempting to tag opposing players while on the opposing team's territory area, defining a tagged player.

17. A method of establishing game play for a capture the flag game on a terrain in low-light conditions with at least first and second teams and multiple players on each team, comprising:

providing a kit of parts comprising:

a first flag having a light emitting diode (LED) providing a first color assigned to the first team, and configured to be selectively disposable upon or attachable to the terrain;

a second flag having an LED providing a second color, different from the first color, and assigned to the second team, and configured to be selectively disposable upon or attachable to the terrain;

a first plurality of team identifiers wearable on the wrists of players of the first team, each of the first plurality of team identifiers having an LED providing the first color to identify team affiliation for the players on the first team;

a second plurality of team identifiers wearable on the wrists of players of the second team, each of the second plurality of team identifiers having an LED providing the second color to identify team affiliation for the players on the second team;

a plurality of territory markers each having an LED providing a third color, different from the first and second colors, and configured to be selectively disposable upon or attachable to the terrain to define a game play territory area upon the terrain for each of the first and second teams;

a first plurality of jail markers each having an LED providing the first color and configured to be selectively disposable upon or attachable to the terrain to define a first game play jail area upon the terrain for the first team; and a second plurality of jail markers each having an LED providing the second color and configured to be selectively disposable upon or attachable to the terrain to define a second game play jail area upon the terrain for the second team; and the first color being associated with the first flag, the first plurality of team identifiers and the first plurality of jail markers;

the second color being associated with the second flag, the second plurality of team identifiers and the second plurality of jail makers; and the third color being associated with the plurality of territory markers; and the first color being associated with the first flag, the first plurality of team identifiers and the first plurality of jail markers;

the second color being associated with the second flag, the second plurality of team identifiers and the second plurality of jail makers; and the third color being associated with the plurality of territory markers;

assigning the first and the second flags to the first and second teams, respectively;

distributing the first and second team identifiers to the players of the first and second teams, respectively;

distributing the plurality of territory markers to define a game play territory area on the terrain for each team;

distributing the first and second plurality of jail markers to define a game play jail area within the first and second team's territory area, respectively, on the terrain; and each team placing their flag in their respective territory area.

18. The method of claim 17, wherein distributing the plurality of territory markers further comprises distributing at least seven territory markers defining a polygon with at least three of the markers arrayed intersecting the polygon at a midpoint to define the territory areas for each team.

19. The method of claim 17, wherein distributing the territory markers further comprises distributing at least six territory markers defining first and second territories for the first and second teams, respectively.

20. The method of claim 17, wherein distributing the first and second plurality of jail markers further comprises distributing the jail markers to define a polygon for each of the first and second teams, respectively.

* * * * *